US008259975B2

(12) United States Patent
Bally et al.

(10) Patent No.: US 8,259,975 B2
(45) Date of Patent: Sep. 4, 2012

(54) HEARING AID WITH AN ATTENUATION ELEMENT

(75) Inventors: Uwe Bally, Erlangen (DE); Peter Nikles, Erlangen (DE); Erika Radick, Nürnberg (DE); Ulrich Schätzle, Forchheim (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 926 days.

(21) Appl. No.: 12/290,351

(22) Filed: Oct. 30, 2008

(65) Prior Publication Data

US 2010/0054513 A1 Mar. 4, 2010

(30) Foreign Application Priority Data

Sep. 3, 2008 (DE) ..... 10 2008 045 668
Sep. 3, 2008 (DE) ..... 20 2008 011 759 U

(51) Int. Cl.
*H04R 25/00* (2006.01)

(52) U.S. Cl. ..... 381/322; 381/318

(58) Field of Classification Search ..... 381/322, 381/318

See application file for complete search history.

(56) References Cited

U.S. PATENT DOCUMENTS

| | | | | |
|---|---|---|---|---|
| 4,509,193 | A * | 4/1985 | Carlson | 381/113 |
| 5,784,471 | A * | 7/1998 | Bebenroth | 381/322 |
| 5,796,848 | A * | 8/1998 | Martin | 381/320 |
| 5,809,151 | A * | 9/1998 | Husung | 381/322 |
| 7,394,911 | B2 * | 7/2008 | Joergensen et al. | 381/322 |
| 2005/0008178 | A1 * | 1/2005 | Joergensen et al. | 381/322 |
| 2009/0067649 | A1 | 3/2009 | Nikles et al. | |

FOREIGN PATENT DOCUMENTS

| | | | |
|---|---|---|---|
| DE | 9408054 | U1 | 7/1994 |
| DE | 9408490 | U1 | 9/1995 |
| DE | 102007042592 | A1 | 3/2009 |

* cited by examiner

*Primary Examiner* — Thao Le

(57) ABSTRACT

A shielding element and a decoupling element are integrated into a combined attenuation element. The shielding element may be a shielding foil, preferably made of copper. The attenuation element may include a flexible backing foil, preferably a plastic backing foil which supports the shielding foil. It may also include an adhesive layer with which the electronic component is affixed to a housing. The physical properties of all elements of the attenuation element are attuned to one another such that it simultaneously attenuates both electromagnetic alternating fields as well as mechanical oscillations.

18 Claims, 3 Drawing Sheets

HEARING AID WITH AN ATTENUATION ELEMENT

CROSS REFERENCE TO RELATED APPLICATIONS

This application claims priority of German application No. 20 2008 011 759.3 DE filed Sep. 3, 2008, and German application No. 10 2008 045 668.3 which are both incorporated by reference herein in their entirety.

FIELD OF INVENTION

The invention relates to a hearing aid as well as an electronic component for generating or processing electromagnetic alternating fields and sound waves for a hearing aid with a shielding element for attenuating electromagnetic alternating fields and a decoupling element for attenuating mechanical oscillations. The invention also relates to a method for dimensioning the individual components, which are provided to attenuate electromagnetic alternating fields and mechanical oscillations.

BACKGROUND OF INVENTION

Hearing aids are used to supply hearing-impaired persons with suitable auditory signals. The auditory signals generally consist of acoustic signals, which are recorded by the hearing aid, pass through a transmission function therein and are output by way of a loudspeaker, a so-called receiver. The transmission function is converted in a signal processing electronics system, which effects inter alia amplification in certain acoustic frequency ranges. Depending on the type and extent of the hearing damage of the respective hearing aid wearer, different frequency ranges result for the amplification, which however lie within the frequency range of human hearing, as well as different degrees of amplification.

To treat hearing-impaired persons, in addition to hearing aids, devices for tinnitus therapy are also used, which can be largely similar to hearing aids. In contrast to hearing aids, devices for tinnitus therapy frequently generate acoustic output signals, which are independent of acoustic signals recorded by the device. For instance, noises for reducing or covering tinnitus interference noises are generated. The term "hearing aid" is to be understood below both as hearing aids as well as tinnitus therapy devices.

Hearing aids are developed with the smallest possible device volume. A small device volume increases the wearing comfort on the one hand, and also reduces the conspicuousness on the other hand, which is frequently perceived by hearing aid wearers as unpleasant. A small installation size also plays a special role in ITE devices (in-the-ear) and CiC devices (completely-in-the-canal), which are partially or completely inserted into the auditory canal of the hearing aid wearer.

SUMMARY OF INVENTION

Increasingly smaller electronic components are used in the course of miniaturization. This applies for instance to the electromagnetic receiver. In addition to useful sound, miniaturized electromagnetic receivers for hearing devices also generate parasitic solid-borne sound. They have very minimal masses and material strengths, so that only a minimal inherent attenuation of mechanical oscillations and/or vibrations results. The receiver housing thus vibrates and the vibrational energy can be transmitted to further parts of the hearing device by way of attachment and mechanical constructional elements of the hearing device structure.

In addition to miniaturized receivers, miniaturized microphones are also used in hearing aids. It likewise applies here that they only have a minimal inherent attenuation. Mechanical oscillations of the receiver, which can be routed as solid-borne sound via the hearing aid structure, are thus also transmitted to the microphone or microphones. Since the microphone signal in the hearing aid is routed again to the receiver as an amplified signal, there is a very high risk that solid-borne sound bridges may result in feedbacks in the hearing device. Feedbacks are generally perceived as an extremely unpleasant whistling sound, which is exceedingly irksome for the hearing aid wearer.

In order to reduce the risk of feedbacks and/or to reduce the transmission of mechanical oscillations from the receiver to the microphone via the hearing aid structure, receivers are positioned as far as possible from the microphones. This allows vibrations from the receiver at the site of the microphone to have already died out. One further measures consists in receivers being mounted in elastic supports, mostly soft rubber retainers, which are to prevent a solid-borne sound transmission from the receiver to the hearing aid housing. In addition, microphones are already mounted in such supports in order to prevent solid-borne sound from transferring from the hearing aid housing to the microphone housing.

The elastic supports take up considerable space, particularly if a very effective solid-borne sound insulation is to be achieved. By contrast, with a compact, small design, they are mostly only inadequate. An overall compact, small design of the hearing aid housing also renders the distance between the receiver and microphones smaller. A compromise between the miniaturization of the installation size and the desired efficiency of the solid-born sound insulation must thus generally be suggested.

In addition to vibrations, miniaturized electromagnetic receivers also generate parasitic electrical and magnetic scatter fields. These negatively affect the function of adjacent electronic components. The scatter fields can be recorded by magnetic antennae. So-called telecoil antennae for the inductive transmission of telephone receiver signals in the acoustic frequency band or wireless coil antennae for the magnetic near field transmission of modulated signals on a carrier frequency can be affected hereby. However, electrical fields can be effectively reduced by connecting the metallic housing to the reference potential of the hearing device. Nevertheless, it is difficult to reduce magnetic scatter fields of the receiver in a simple fashion.

For magnetic shielding, in particular of the telecoil antenna in the acoustic frequency band, highly permeable sheets are positioned around the receiver. These nevertheless require appreciable space and are thus unsuited to ITE devices and to small BTE devices (behind-the-ear) due to the miniaturization required. For magnetic shielding, in particular of the wireless coil antenna, in respect of low carrier frequencies of less than 1 MHz, highly permeable sheets are likewise considered or instead highly conductive shielding foils or highly conductive sheets. Just as in the acoustic frequency band, the lower carrier frequencies in the frequency band are unsuited to ITE and small BTE devices for space-related reasons.

To this end, it results that shielding foils at least hinder the design and construction. Even if sufficient space is available, additional installation space must also be made available for the shielding foil. In addition, it is to be considered as a special component especially in the design engineering.

The object of the invention consists in specifying a hearing aid as well as an electronic component for generating or processing electromagnetic alternating fields and sound waves for a hearing aid, in which a significant attenuation both of electromagnetic alternating fields as well as mechanical oscillations of the electronic component is achieved and which simultaneously have a reduced installation volume.

This object is achieved in accordance with the invention by a hearing aid as well as by an electronic component with the features of the independent claims.

One basic idea behind the invention in respect of its device aspects consists in a hearing aid comprising a housing, in which electronic signal processing components are arranged, which include an electronic component for generating or processing electromagnetic alternating fields and sound waves and in which provision is made for a shielding element for attenuating electromagnetic alternating fields and a decoupling element for attenuating mechanical oscillations, with the shielding element and the decoupling element being integrated in a combined attenuation element.

By combining the shielding element and the decoupling element into an integrated attenuation element, individual components of the two elements can assume a dual function. For instance, the mass of a shielding can simultaneously be provided as an attenuating torque for mechanical oscillations. Or an elastic element of the mechanical decoupling can be provided at the same time as the constructional element supporting the shielding element. By mutually integrating and/or using individual elements in a dual function, the number of elements and thus the installation volume can be reduced. Mechanical attenuation properties of the shielding element are predominantly included here in the attenuation effect of the decoupling element, in order to increase its efficiency.

This basic idea behind the invention thus consists in not considering the two problems of solid-borne sound insulation and magnetic shielding separately, but instead integrating the functions of the solution approaches in a highly effective and consequently space-saving bond.

In an advantageous development of the invention, the shielding element is a highly conductive shielding foil with a higher density than aluminum. Aluminum nevertheless ensures a good shielding effect and is also easily available and processible. However, aluminum has a low density and thus a low mass, which renders it unsuitable for attenuating mechanical oscillations. The use of a material with a higher density and thus a higher mass, which is suited to shielding, additionally produces a more significant attenuation of mechanical oscillations. As a result, an additional functionality as a mechanical attenuation element is integrated into the functionality of the shielding element. This mutual integration contributes to reducing the number of components and thus to reducing the installation volume. The shielding element can particularly advantageously consist of copper.

In a further advantageous development of the invention, the decoupling element has a backing foil. The shielding foil is advantageously supported by the backing foil. An additional mutual integration of the attenuation and shielding elements is thus achieved. The backing foil can particularly advantageously be a plastic backing foil, e.g. a polyimide foil. The adjustment of suitable backing foil properties predominantly effects the selection of the foil material, the dimensioning of the Shore hardness and the dimensioning of the foil thickness. For the flexible adjustment to different geometries, the shielding foil can be manufactured on a thin plastic backing foil in particular in a printed circuit board process (PCB), thereby ensuring huge flexibility in respect of possible moldings.

In a further advantageous development of the invention, the decoupling element has an adhesive layer. Foils for magnetic shielding with an adhesive layer are in particular usually directly affixed to the housing of the receiver. By including the adhesive layer in the decoupling element, the degree of mutual integration of constructional elements is increased and the number or the installation volume of the components can be reduced. In particular, the attenuation effect of the adhesive layer is utilized such that either an additional decoupling element can be omitted or at least minimized in terms of the installation volume. The adjustment of suitable properties of the adhesive layer relates here predominantly to the dimensioning of the robustness and the dimensioning of the layer thickness.

In a further advantageous development of the invention, the decoupling element includes an elastic support, with which the electronic component is mounted on the housing. The attenuation effect of the elastic support, in conjunction with the mass of the housing, can advantageously be included in the attenuation effect of the attenuation element. In this way, the additional elements used for the mechanical attenuation can be designed for a more minimal attenuation and if necessary reduced in terms of installation volume.

To achieve the inventive simultaneous attenuation of electromagnetic alternating fields and mechanical oscillations, the attenuation properties of the adhesive layer and the elastic spring force of the backing foil and the mass of the shielding foil are attuned to one another such that the attenuation element and at the same time the attenuation of electromagnetic alternating fields and the attenuation of mechanical oscillations is maximized. If necessary, the additional elastic spring force of the elastic support and the attenuation properties of the elastic support and the mass of the housing are included in the mutual tuning to one another.

One basic idea behind the invention in respect of its method aspects consists in a method for dimensioning the elements of a combined attenuation element for simultaneously attenuating electromagnetic alternating fields and mechanical oscillations, with the attenuation element including a backing foil, a shielding foil and an adhesive layer, having the method steps:

- determining an electromagnetic frequency range for electromagnetic alternating fields, in which the electromagnetic attenuation is to be maximized,
- determining an electrical dimensioning for the shielding foil, compliance with which favors the maximization of the electromagnetic attenuation of the combined attenuation element in the electromagnetic frequency range,
- determining a mechanical frequency range for mechanical oscillations, in which the mechanical attenuation is to be maximized,
- by retaining the determined electrical dimensioning, determining mechanical dimensionings of the shielding foil, the backing foil and the adhesive layer, which are mutually dependent on one another, compliance with which favors the maximization of the mechanical attenuation of the combined attenuation element in the mechanical frequency range.

In an advantageous development of the invention, with the method, an electrical insulation layer can additionally also be taken into account in respect of its mechanical attenuation properties.

In an advantageous development of the invention, an additional elastic support to be included can also be taken into account in respect of its mechanical attenuation properties.

In a further advantageous development of the invention, a frequency range can be predetermined, in which as strong an attenuation as possible is to be achieved. The frequency range can be selected such that a strong attenuation is achieved precisely in the frequencies applicable to a hearing aid. For instance, the electromagnetic frequency range of a wireless coil, a so-called telecoil for receiving telephone receiver signals, a Bluetooth interface or the sound wave frequency range of human speech or of human hearing can provide the basis.

With an increased attenuation effect brought on by suitable dimensioning of the individual elements, more minimal dimensioning of the elastic support is at the same time to be aimed for. A smaller dimensioning of the elastic support may contribute to reducing the overall hearing aid volume.

Instead, it is however also possible to dispense with reductions in the hearing aid volume and instead use the increased attenuation effect and operate the receiver at high power, without feedbacks occurring.

BRIEF DESCRIPTION OF THE DRAWINGS

Further advantageous developments of the invention result from the dependent claims and the description of exemplary embodiments that follow, with reference to the Figures, in which;

DETAILED DESCRIPTION OF INVENTION

Figure 1:
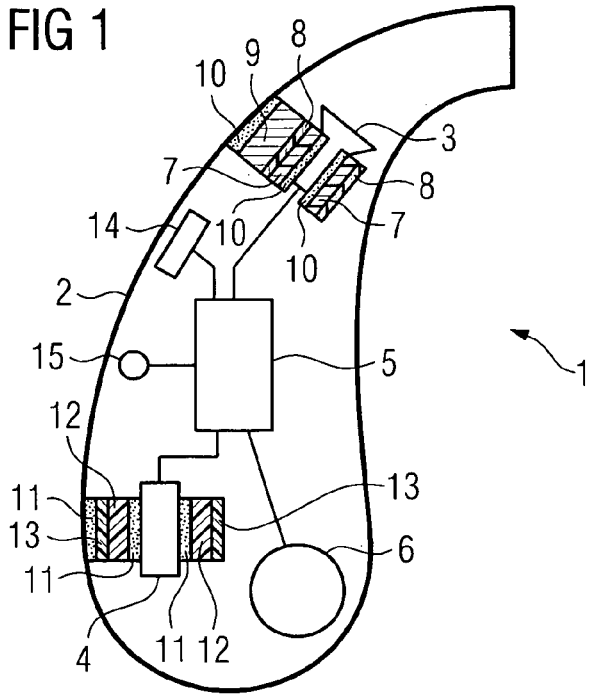
FIG. 1 shows a hearing aid with attenuation elements

FIG. 1 shows a schematic representation of a hearing aid 1 with an attenuation element. A patented housing 2 of the hearing aid 1 is shown, in which the essential electronic components, which belong to the signal processing electronic system, are shown.

These electronic components include a receiver 3, which generates acoustic signals, which are to be fed to an ear of the hearing aid wearer. The receiver 3 is connected to a signal processing facility 5, the essential object of which is the processing of recorded acoustic signals and the amplification thereof. It is connected to a microphone 4, which is used to receive acoustic signals. Its power supply supplies the signal processing facility 5 from a battery 6.

Further electronic components, e.g. a telecoil 14 for receiving telephone receiver signals, or a wireless coil 15, are likewise provided in the housing. Furthermore, further components (not shown), e.g. a Bluetooth antenna for receiving data communication signals, could likewise be provided in the housing 2 of the hearing aid 1.

The microphone 4 converts acoustic sound waves into electrical signals, alternating fields etc. The receiver 3 for its part converts electrical alternating fields into acoustic signals. The receiver 3 and the microphone 4 thus generate and/or process electromagnetic alternating fields and/or sound waves. The sound waves generated by the receiver 3 accompany vibrations of the receiver 3 itself, which can transmit themselves onto the housing and/or onto constructional elements and electronic components arranged in the housing 2.

The receiver 3 here has amplified electrical alternating signals from the signal processing facility 5 applied to it, said alternating signals being converted in a coil of the receiver 3 into electrical and magnetic alternating fields. The electrical and magnetic alternating fields are used to generate sound waves, but nevertheless also produce interference fields in the process, which can inject into any electronic components in the housing 2 of the hearing aid as well as in the direct vicinity thereof. As a result they interfere on the one hand with other electronic components, on the other hand the injection of scatter fields in surrounding components and other components produces an unwanted loss of power.

A shielding foil 7 is provided to shield the receiver 3 in respect of electrical as well as magnetic alternating fields. To shield against low-frequency magnetic fields, they can consist of highly permeable material. To shield against high frequency magnetic fields, they can consist of a highly conductive material. The shielding foil 7 is preferably produced from copper. To shield against electrical alternating fields, the shielding foil can consist of a highly conductive material and be connected to the reference potential of the hearing aid 1 and/or signal processing facility 5. To shield against magnetic fields, they can also consist of highly permeable material. The shielding foil 7 is preferably made of copper.

The shielding foil 7 is supported by a plastic backing foil 8. The plastic backing foil 8 can consist of polyimide for instance. It can be used in a printed circuit board process (PCB) and the shielding foil 7 can be advantageously applied to the plastic backing foil 8 within the scope of this process. This process ensures particularly high flexibility in respect of molding and design.

The shielding foil 7 on the plastic backing foil 8 is directly affixed to the receiver 3 with the aid of an adhesive layer 10. As a result, as close a shielding of the receiver 3 as possible against electrical and magnetic alternating fields is produced.

The receiver 3 shielded in such a fashion is mounted by means of an elastic support 9, e.g. a soft rubber support, in the housing 2. The elastic support 9 is fixedly connected to the receiver 3 (not shown in more detail), e.g. by means of a mechanical or adhesive connection. It is affixed to the housing 2 by means of an adhesive layer 10. Vibrations are attenuated by means of the resulting elastic attachment of the receiver 3 in the housing and can only be transmitted from the receiver 3 to the housing 2 to a minor degree. Solid-borne sound bridges are as a result prevented or at least reduced.

The mechanical and/or physical properties of the overall attachment and shielding of the receiver 3 is shown below: The adhesive layer 10 has a predetermined robustness, which effects an attenuation in combination with its layer thickness. The elastic support 9 has on the one hand attenuating properties, and on the other hand an elastic spring force. The plastic backing foil 8 essentially exhibits elastic properties, in other words elastic spring force, which results from the Shore hardness and the material thickness. The shielding foil 7 is essentially metallic and is thus not notably attenuating or elastic per se. It thus represents a mass. In mechanical terms, the whole attachment system of the receiver 3 forms an oscillating system. The individual elements of this system are attuned to one another in respect of their physical and/or mechanical properties such that the oscillating system effects as strong an attenuation of mechanical oscillations as possible, in other words vibrations and/or solid-borne sound.

The microphone 4 is suspended in a similar system on the housing 2. A bond made of a shielding foil 13 on a plastic backing foil 12 is affixed to the microphone 4 by means of an adhesive layer 11. Dispensing with an elastic support allows the overall system to be affixed to the housing 2 by means of an additional adhesive layer 11. The individual elements of the attachment system of the microphone 4 are likewise attuned to one another such that the resulting oscillating system effects as strong an attenuation of mechanical oscillations as possible.

Figure 2A:
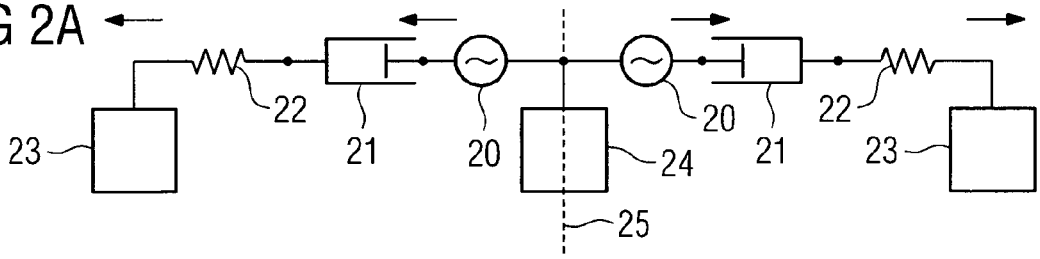
FIG. 2A shows an equivalent circuit diagram with two semi-oscillating circuits

FIG. 2A shows a mechanical equivalent circuit diagram with a series oscillating circuit divided into two symmetrical semi oscillating circuits, which likewise map the previously described system of receiver 3. The behavior of a mechanical series oscillating circuit particularly approximates the dynamic behavior of the setup in the hearing aid 1.

A decoupling of mechanical oscillations is to be effected in the mechanical oscillation system, said oscillations transmitting themselves via the attachment to the housing wall and finally to the microphone. The receiver 3 is shown there as an oscillating generator 20. The center of gravity 24 of the receiver 3 is central in the case of hearing aids and is arranged in close proximity to the symmetrical plane 25 of the hearing aid. The receiver 3 thus exerts approximately the same forces 20 on the mechanical structures on both its sides. Its center of gravity barely moves as a result of the symmetry and can be replaced in the simulation by the symbol of the resting potential.

Figure 2B:
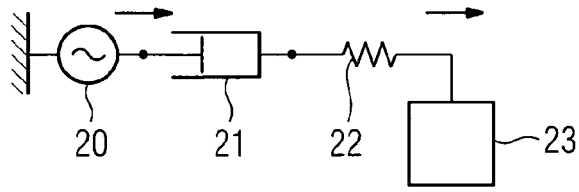
FIG. 2B shows an equivalent circuit diagram with an oscillating circuit

Furthermore, the observation of only one of the two symmetrical halves, as shown in FIG. 2B, is then sufficient. The adhesive layer 11 acts in an oscillation-attenuating fashion as a result of its robustness and is thus shown in the equivalent circuit diagram as an attenuator 21. The plastic backing foil 12 essentially has elastic properties, which are represented in the equivalent circuit diagram by means of a spring 22. The oscillation properties of the shielding foil 13 are essentially represented as mass forces, which are thus represented in the equivalent circuit diagram as a mass 23.

For the electrical dimensioning of the components of the series oscillation circuit, the electromagnetic frequency ranges which are typical of hearing aids and are used for the operation of receiver 3, microphone 4, telecoil 14 and wireless coil 15, are to be taken as a basis. Subject to the electrical component dimensions predetermined by the frequency ranges to be used, variation possibilities result for the physical and/or mechanical dimensioning of the components, which can be used to minimize mechanical oscillations, e.g. solid-borne sound.

Models, which exhibit electrical analogies and with the aid of which usual methods can be calculated can help with the mechanical dimensioning. For the calculation, circuit simulation tools, like for instance P-spice, can be used for instance. Known calculation or simulation methods allow the series oscillating circuit to now be optimized by varying the electrical dimensioning of its components, such that as strong a mechanical attenuation as possible results.

The determined mechanical dimensionings of the components of the oscillating circuit are then used to derive therefrom dimensionings of the actual components used in the hearing aid 1. A suitable robustness and layer thickness of the adhesive layer 11 is concluded here from the attenuation 21, a suitable foil thickness and Shore hardness of the plastic backing foil 12 can be concluded from the spring 22 and a suitable mass and thus material selection and the layer thickness of the shielding foil can be concluded from the mass 23.

Figure 3:
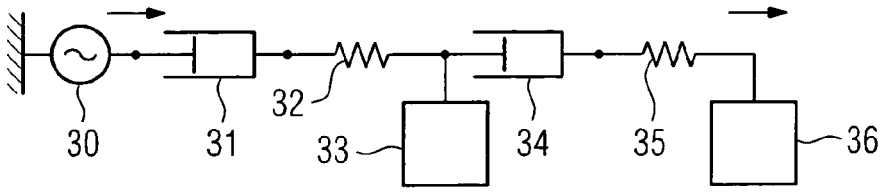
FIG. 3 shows an equivalent circuit diagram with two oscillating circuits

FIG. 3 shows an equivalent circuit diagram which can be compared to that of the afore-described, and has two mechanical series oscillating circuits. The insertion of the second mechanical series oscillating circuit takes the dynamic properties of the housing 2 of the hearing aid 1 into account and results in a more precise model with improved simulation results.

As likewise described previously, an oscillating generator 30 represents the previously described receiver 3 as an oscillating source. The attenuator 31 represents the adhesive layer 10, the spring 32 represents the plastic backing foil 8, the mass 33 represents the mass forces of the backing foil 7. To this end, there is a further attenuator 34, which represents the elastic spring force of the elastic support 9, a further spring 35 for the elastic spring force of the elastic support 9 as well as an additional mass 36, which represents the mass of the housing 2, or at least one relevant variable which forms the basis of the mass of the housing 2.

The previously described series oscillating circuit would thus be extended by a further series oscillating circuit associated therewith, which takes the elastic support 9 in the housing 2 into account. The use of known calculation and simulation methods allows the illustrated dual series oscillation circuit to be likewise set up like the previously illustrated simple series oscillating circuit in respect of the electrical dimensioning of its components at the frequency ranges to be used and in respect of the mechanical dimensions, in order to maximize the attenuation. As described previously, the actual electrical and mechanical dimensionings of the components of the hearing aid 1 are then derived from the dimensionings of the components thus determined. A third series oscillating circuit can be extended for a further refinement of the model, which still takes account of the microphone as well as its support.

Figure 4:
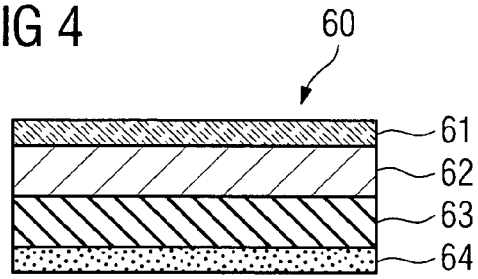
FIG. 4 shows a layered system of the attenuation element

FIG. 4 shows a schematic sectional image of a preferred embodiment of a layered design 60 for the combined attenuation element. The layered design 60 is based on an adhesive foil 64, which can likewise consist for instance of a thickness of 10 μm and be made of polyurethane. An elastomer layer 63, which has a layer thickness of 50 μm for instance and can consist of polyimide, is arranged in the adhesive foil. A metallic layer 62, which can have a layer thickness of 50 μm for instance and can consist of copper, is applied to the elastomer layer 63. Other suitable materials for the metallic layer are to be selected in respect of the attenuation of magnetic alternative fields, so-called Mumetals are likewise suitable for instance, which are based on nickel iron alloys with high magnetic permeability. An electrical insulation layer is arranged on the metallic layer 62, which has a layer thickness of 10 μm for instance and can consist of epoxy resin.

The illustrated layered design functions as a combined attenuation element 60 and can be used for the combined mechanical as well as electrical oscillation attenuation when attaching the receiver 3 and microphone 4 of the hearing aid 1. The selected layered dimensionings and materials result for the electromagnetic frequency ranges to be used in hearing aids and the resulting mechanical and/or acoustic frequencies and component variables produce a simultaneously maximum attenuation both of electromagnetic as well as mechanical oscillations.

Figure 5:
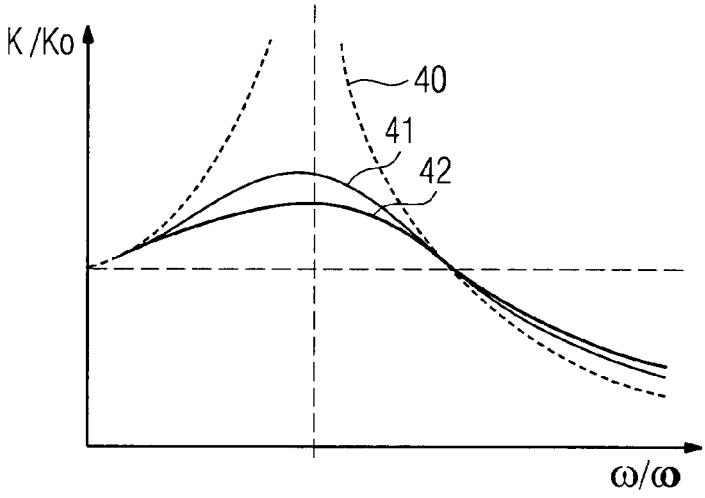
FIG. 5 shows resonance curves for different attenuations

FIG. 5 shows an exemplary resonance curve for the previously described combined mechanical as well as electromagnetic attenuation element. The mechanical force [K/K°] is plotted over the frequency [Ω/Ω°]. 3 resonance curves for different attenuations by the combined attenuation element are illustrated by way of example. By comparison, the resonance curve 40 represents the behavior of an almost unattenuated oscillation system with an almost unattenuated oscillation transmission in the resonance frequency range, indicated by the vertically dashed line. The resonance curve 41 represents a comparably mean attenuating behavior of the oscillating system with a well attuned combined mechanical and electromagnetic attenuation element. In the region of the resonance frequency, a significantly reduced force is produced in the comparison with the unattenuated resonance curve 40. In frequency ranges further from the resonance frequency, only smaller differences in attenuation behavior arise. The significantly attenuated resonance curve 42 finally represents the attenuation behavior of a particularly well attuned attenuation element.

When determining optimal dimensionings for the components of the hearing aid as well as the elements of the combined electromagnetic and mechanical attenuation element, an optimized attenuation behavior according to the resonance curve 42 is desired.

Figure 6:
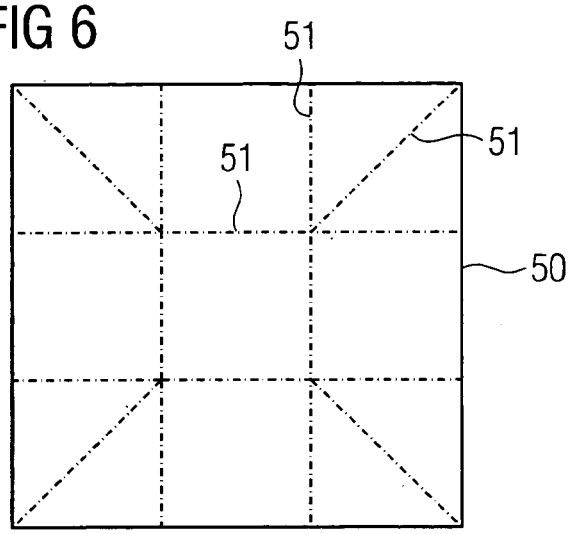
FIG. 6 shows an embodiment of a shielding foil FIG. 7, 8 show production steps for a shielding entity
Figure 7:
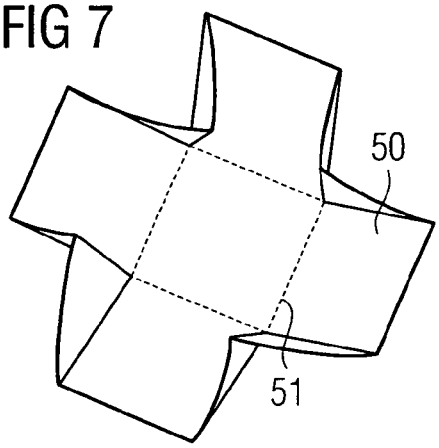
Figure 8:
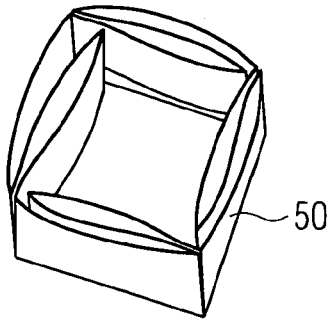

FIG. 6 shows a particularly advantageous manner of producing a shielding for a receiver 3 from a shielding foil 50 in an effortless fashion. Here the dashed lines 51 are understood as folding lines, along which the shielding foil 50 is to be folded. This is described in more detail in the FIGS. 7 and 8 shown below. The shielding foil 50 can be a layered design made of an adhesive layer, an elastomer layer, a metallic layer and an insulation layer, as described above. The layered bond produces a mechanically particularly easily processible shielding foil.

FIG. 7 shows a partially folded view of the previously described shielding foil in a first work process, namely folded along the dashed folding lines 51. The manner in which the shielding foil is meant to be folded is obvious from the illustrated intermediate stage.

FIG. 8 shows the shielding foil in the final folding state. A shielding box is produced which can accommodate a receiver for instance. A processing of the shielding foil 50 of this type solely by folding reduces the use of additional processing steps, e.g. adhesion or other molding measures and can thus be implemented in a particularly effortless fashion.

Figure 9:
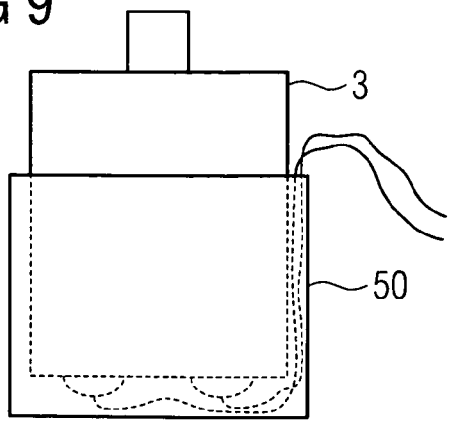
FIG. 9 shows a schematic representation of producing the shielding box.

FIG. 9 shows a schematic representation of how the shielding box produced by folding the shielding foil 50 can accommodate the receiver 3. The receiver 3 is placed in the box made of shielding foil 50. The special manufacturing manner of the box, namely by means of folds, allows openings in the box to be avoided completely, so that a particularly tight shielding of the receiver 3 is produced. The electrical connections of the receiver as well as the electrical supply lines are likewise shown schematically, but however not provided with reference characters.

The basic ideas behind the invention can be summarized as follows: The invention relates to a hearing aid 1 as well as an electronic component 3, 4 for generating or processing electromagnetic alternating fields and sound waves for a hearing aid 1 with a shielding element 7, 13 for attenuating electromagnetic alternating fields and a decoupling element for attenuating mechanical oscillations. The invention also relates to a method for dimensioning the individual components, which are provided for attenuation. According to the invention, the shielding element 7, 13 and the decoupling element are integrated in a combined attenuation element. The shielding element 7, 13 can be a shielding foil, preferably made from copper. The shielding element can include a flexible backing foil, preferably a plastic backing foil, which supports the shielding foil. It can also include an adhesive layer 10, 11, with which the electronic component 3, 4 is affixed to a housing 2. The physical properties of all elements of the attenuation element are attuned to one another such that it significantly attenuates both the electromagnetic alternating fields as well as mechanical oscillations at the same time.

The invention claimed is:

1. A hearing aid, comprising:

a housing;

an electronic component included in the housing; and a combined attenuation element included in the housing and having:

an integrated shielding element that attenuates electromagnetic alternating fields, the shielding element is a highly conductive shielding foil with a higher density than aluminum, the shielding foil is supported by a backing foil, and an integrated decoupling element that attenuates mechanical oscillations, the decoupling element includes an adhesive layer, wherein the combined attenuation element shields the electronic component in respect to electrical and magnetic alternating fields and attenuates mechanical oscillations in regards to the electronic component.

2. The hearing aid as claimed in claim 1, wherein the electronic component is affixed to the housing via the adhesive layer.

3. The hearing aid as claimed in claim 1, wherein the electronic component generates electromagnetic alternating fields and sound waves.

4. The hearing aid as claimed in claim 1, wherein the electronic component processes electromagnetic alternating fields and sound waves.

5. The hearing aid as claimed in claim 1, wherein attenuation properties of the adhesive layer, an elastic spring force of the backing foil and the mass of the shielding foil are attuned to one another for simultaneously maximizing the attenuation of electromagnetic alternating fields and the attenuation of mechanical oscillations.

6. The hearing aid as claimed in claim 1, wherein the decoupling element includes an elastic support with which the electronic component is mounted on the housing.

7. The hearing aid as claimed in claim 6, wherein attenuation properties of the adhesive layer, an elastic spring force of the backing foil, a mass of the shielding foil, an elastic spring force of the elastic support, attenuation properties of the elastic support and the mass of the housing are attuned to one another for simultaneously maximizing the attenuation of electromagnetic alternating fields and the attenuation of mechanical oscillations.

8. The hearing aid as claimed in claim 1, wherein the shielding foil consists of copper or a Mumetal and has a layer thickness of 35-65 μm, wherein the backing foil consists of an elastomer and has a layer thickness of 35-65 μm, and wherein the adhesive layer consists of a polyurethane and has a layer thickness of 5-15 μm.

9. The hearing aid as claimed in claim 8, wherein the shielding foil has a layer thickness of 50 μm, wherein the backing foil has a layer thickness of 50 μm, and wherein the adhesive layer has a layer thickness of 10 μm.

10. The hearing aid as claimed in claim 8, further comprising an insulation layer consisting of an epoxy resin and has a layer thickness of 5-15 μm.

11. The hearing aid as claimed in claim 10, the insulation layer has a layer thickness of 10 μm.

12. The hearing aid as claimed in claim 1, wherein the shielding foil comprises copper or a Mumetal, wherein the backing foil comprises an elastomer, and wherein the adhesive layer comprises a polyurethane.

13. The hearing aid as claimed in claim 12, further comprises an insulation layer comprising an epoxy resin.

14. The hearing aid as claimed in claim 1, wherein the electronic component is a receiver or a microphone.

15. The hearing aid as claimed in claim 1, further comprising a wireless coil in the housing.

16. The hearing aid as claimed in claim 1, further comprising a telecoil in the housing.

17. A method for dimensioning the elements of a combined attenuation element for simultaneously attenuating electromagnetic alternating fields and mechanical oscillations, comprising:

providing the attenuation element, the attenuation element including a backing foil, a shielding foil and an adhesive layer;

determining an electromagnetic frequency range for electromagnetic alternating fields, in which the electromagnetic attenuation is to be maximized;

determining an electrical dimensioning for the shielding foil, compliance with which favors the maximization of electromagnetic attenuation of the combined attenuation element in the electromagnetic frequency range;

defining a mechanical frequency range for mechanical oscillations, in which the mechanical attenuation is to be maximized; and complying with the determined electrical dimensioning, determining mechanical dimensioning of the shielding foil, the backing foil and the adhesive layer, which are mutually dependent on one another, compliance with which favors the maximization of the mechanical attenuation of the combined attenuation element in the mechanical frequency range.

18. A method for dimensioning the elements of a combined attenuation element for simultaneously attenuating electromagnetic alternating fields and mechanical oscillations, comprising:

providing the attenuation element, the attenuation element including a backing foil, a shielding foil, an adhesive and an insulation layer;

determining an electromagnetic frequency range for electromagnetic alternating fields, in which the electromagnetic attenuation is to be maximized;

determining an electrical dimensioning for the shielding foil, compliance with which favors the maximization of the electromagnetic attenuation of the combined attenuation element in the electromagnetic frequency range; and defining a mechanical frequency range for mechanical oscillations, in which the mechanical attenuation is to be maximized, wherein retaining the determined electrical dimensioning, determining mechanical dimensioning of the shielding foil, the backing foil, the adhesive layer and the insulation layer, which are mutually independent of one another, compliance with which favors the maximization of the mechanical attenuation of the combined attenuation element in the mechanical frequency range.

* * * * *